US005778975A

United States Patent [19]

Nilsson

[11] Patent Number: 5,778,975

[45] Date of Patent: Jul. 14, 1998

[54] PLATE HEAT EXCHANGER

[75] Inventor: Mats Nilsson, Lund, Sweden

[73] Assignee: Alfa Laval AB, Lund, Sweden

[21] Appl. No.: 793,384

[22] PCT Filed: Sep. 21, 1995

[86] PCT No.: PCT/SE95/01073

§ 371 Date: Feb. 21, 1997

§ 102(e) Date: Feb. 21, 1997

[87] PCT Pub. No.: WO96/09513

PCT Pub. Date: Mar. 28, 1996

[30] Foreign Application Priority Data

Sep. 22, 1994 [SE] Sweden ..... 9403200

[51] Int. Cl.[6] ..... F28F 3/08

[52] U.S. Cl. ..... 165/167; 165/166; 165/174

[58] Field of Search ..... 165/174, 167, 165/153, 144, 166, 165

[56] References Cited

U.S. PATENT DOCUMENTS

| | | | |
|---|---|---|---|
| 4,090,556 | 5/1978 | Almqvist | 165/167 X |
| 4,386,652 | 6/1983 | Dragojevic | 165/144 |
| 4,396,002 | 8/1983 | Lipets | 165/144 X |
| 4,813,478 | 3/1989 | Jönsson et al. | 165/167 X |
| 5,400,853 | 3/1995 | Wolters | 165/144 X |
| 5,435,383 | 7/1995 | Rajagopal | 165/167 |

FOREIGN PATENT DOCUMENTS

| | | |
|---|---|---|
| 0 377 936 | 7/1990 | European Pat. Off. . |
| 0 514 248 A1 | 11/1992 | European Pat. Off. . |
| 0 521 489 A1 | 1/1993 | European Pat. Off. . |
| 1 679 429 | 3/1972 | Germany . |
| 22 09 395 | 1/1979 | Germany . |
| 25 27 370 | 1/1981 | Germany . |
| 116000 | 3/1946 | Sweden . |
| 1 207 016 | 9/1970 | United Kingdom . |

OTHER PUBLICATIONS

PCT Int. Search Report.

*Primary Examiner*—John Rivell
*Assistant Examiner*—Christopher Atkinson
*Attorney, Agent, or Firm*—Fish & Richardson P.C.

[57] ABSTRACT

The present invention refers to a plate heat exchanger (1) for heat transfer between two fluids, comprising several permanently joined modules (2), each consisting of two outer heat transfer plates (3) and between these several principally rectangular inner heat transfer plates (4), which have openings (10) for respective fluids in their corner portions, which form flow passages through the plate heat exchanger (1), said outer heat transfer plates (3) showing smaller openings (10) for at least one of the fluids than said inner heat transfer plates (4) and said modules (2) being joined with each other around said openings (10) in respective outer heat transfer plates (3). In the present invention at least one of the fluids is arranged to flow through the plate heat exchanger (1) in several passes, and at least a disc of a pass (13) is introduced in at least one flow passage and is arranged towards two outer heat transfer plates (3) joined with each other to essentially seal said opening (10).

10 Claims, 3 Drawing Sheets

PLATE HEAT EXCHANGER

FIELD OF THE INVENTION

The present invention refers to a plate heat exchanger for heat transfer between two fluids, comprising several permanently joined modules, each consisting of two outer heat transfer plates and between them several principally rectangular inner heat transfer plates, which have openings for respective fluids in their corner portions, to form flow passages through the plate heat exchanger, said outer heat transfer plates showing smaller openings for at least one of the fluids than said inner heat transfer plates and said modules being joined to each other around said openings in respective outer heat transfer plates.

BACKGROUND OF THE INVENTION

It has until now not been possible to let the fluid flow in several passes through a permanently joined plate heat exchanger constructed of modules. The flow in several passes can be attained by delimiting several sections of heat transfer plates from each other, in which the fluid first flows through one section and subsequently in series flows through the remaining sections. The definition of a pass comprises a flow path from one of the flow passages, through several parallel plate interspaces, to the other flow passage. In several passes the fluid consequently flows back and forth between the flow passages.

However, it is previously known in a conventional plate heat exchanger, provided with gaskets, to let one of the fluids flow through the plate heat exchanger in several passes. For instance, in GB 1522369 such a plate heat exchanger is shown, in which two passes are provided by leaving one or several heat transfer plates non perforated, i.e. the portion of a heat transfer plate that normally is cut away, to make an inlet opening, has been kept. The plate heat exchanger, which is of conventional kind, comprises gaskets between each pair of heat transfer plates and can thus be taken apart. The heat transfer plates can optionally be replaced by non perforated plates.

In the plate heat exchanger, described in the preamble, non perforated plates cannot be used to achieve several passes. That is because the permanently joined modules are joined to each other around the openings in respective outer heat transfer plates. A problem would appear during welding of several non perforated modules.

SUMMARY OF THE INVENTION

The objects with the present invention are to make it possible, in a plate heat exchanger of the above mention kind, to join modules safely, simultaneously as the plate heat exchanger can be adapted to a flow in several passes.

These objects are attained with the present invention, which principally is characterized in that at least one of the fluids is arranged to flow through the plate heat exchanger in several passes, and that at least a disc of a pass is introduced in at least one flow passage and is arranged towards two outer heat transfer plates joined with each other to essentially close said opening.

To be able to assemble the disc of the pass, an imaginary straight line from the periphery of the disc of the pass through its centre, should have a length, which is shorter than the diameter of the openings in the outer heat transfer plates in at least one direction. This can be attained in that the disc of the pass is essentially circular, with a diameter, which exceeds the diameter of the openings in the outer heat transfer plates, and in that the disc of the pass has a recess, in which an outer heat transfer plate partly can be inserted, and that the distance from the bottom of the recess to the periphery of the disc of the pass in all directions is shorter than the diameter of the openings in the outer heat transfer plates.

By reason that an accumulation of air should not prevent the fluid to reach the plate interspaces closest to the disc of the pass it may, in an upper flow passage, be orientated in such way that the recess is turned upwards, forming an upper slot for ventilation of the flow passage.

Similarly, the fluid should not be left in the plate heat exchanger at drainage of the same, and therefore the disc of the pass may in a lower flow passage be orientated in such way that the recess is directed downwards, forming a lower slot for drainage of the flow passage.

As an alternative the disc of the pass can be of essentially oval shape, with its shorter diameter being shorter than the diameter of the openings in the outer heat transfer plates. This kind of disc of a pass does not cover the openings completely and sometimes far too huge slots are formed, through which the fluid leaks past the disc of the pass. This can be solved through that several discs of the pass are arranged towards each other and turned in relation to each other.

The disc of the pass suggested according to the invention is joined with at least one of two outer heat transfer plates joined with each other through welding, soldering, gluing, riveting or similar.

BRIEF DESCRIPTION OF THE DRAWINGS

The invention will be described more particularly in the following with reference to the accompanying drawings, on which

DETAILED DESCRIPTION

Figure 1:
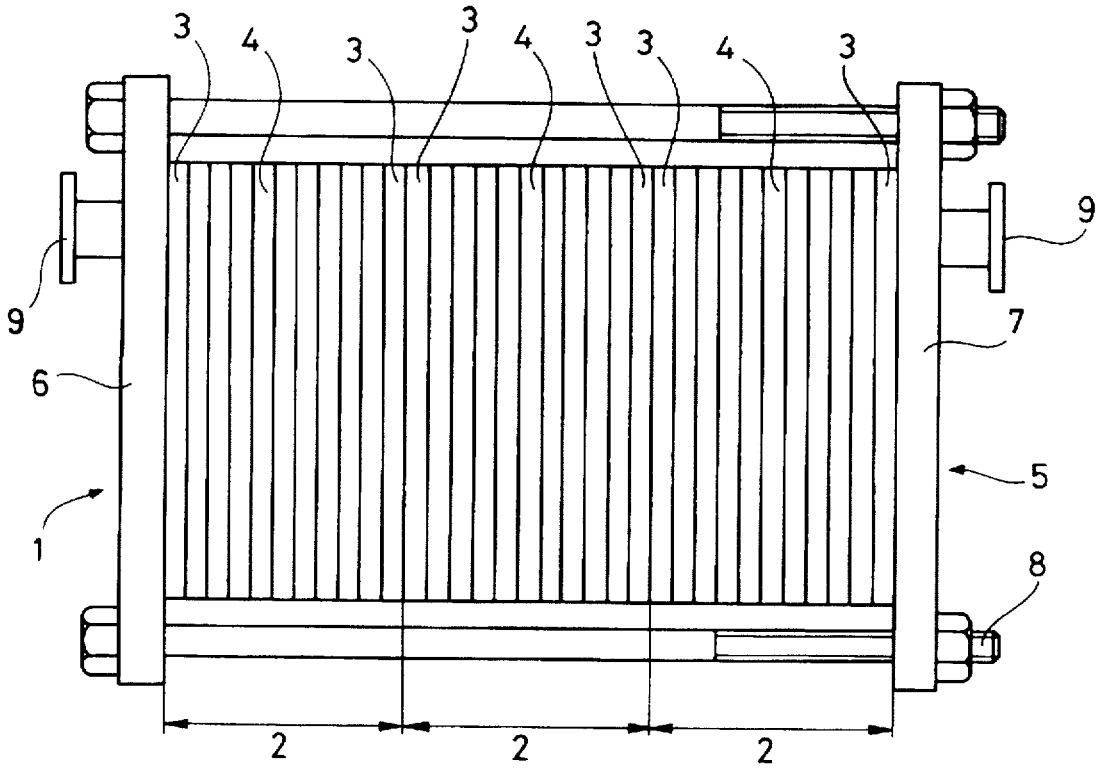
FIG. 1 shows a schematic side-view of a plate heat exchanger with several passes according to the invention.

FIG. 1 shows a plate heat exchanger 1 for heat transfer between two fluids, comprising several permanently joined modules 2, each consisting of two outer heat transfer plates 3 and between them several principally rectangular inner heat transfer plates 4. The modules 2 are located in a frame 5, of conventional kind, comprising at least a front end plate 6 and a rear end plate 7 and several tightening bolts 8. The end plates 6 and 7 have connections 9, which communicate with a flow passage for a first fluid. The connections to the flow passage for the other fluid is not shown.

The heat transfer plates 3 and 4 are through pressing provided with a pattern in shape of ridges and grooves. The ridges of alternating first and second heat transfer plates abut towards each other. The heat transfer plates are welded to each other or in another way permanently joined to each other, for instance by gluing, soldering or combination of that. The heat transfer plates delimit in every other plate interspace a flow space for a first fluid and in the remaining plate interspaces flow spaces for the second fluid.

Figure 2:
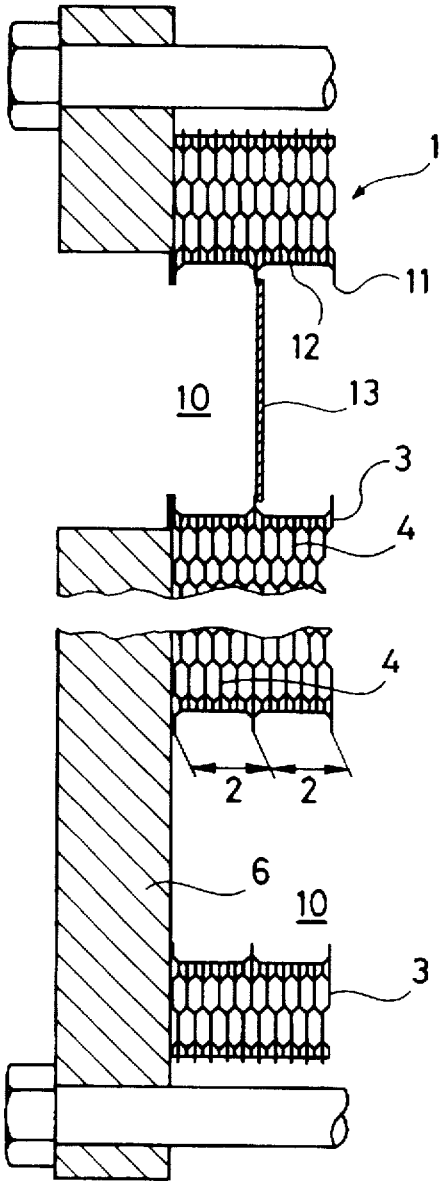
FIG. 2 shows a schematic cross-section through a part of the plate heat exchanger according to FIG. 1, comprising an end plate and two adjacent modules.

FIG. 2 shows a schematic cross-section through a part of the front end plate 6 (without said connection) and through two adjacent modules 2. The outer and inner heat transfer plates 3 and 4 are elongated and mainly rectangular, even if other shapes as rounded also are thinkable, and are produced of thin metal plates that by means of pressing has been provided with a conventional corrugation pattern.

The outer and inner heat transfer plates 3 and 4 have through openings 10 located in corner portions of the heat transfer plates. The openings 10 are generally circular, but other shapes are also thinkable, such as triangular or rectangular, and the shape of the openings does not limit the invention.

The outer heat transfer plates 3 show smaller openings 10 than the inner heat transfer plates 4. By this, the edge 11 of the openings of the outer heat transfer plates 3 extends longer into the flow passages than the edge 12 of the inner heat transfer plates 4.

In that the edge 11 of the modules 2 of the outer heat transfer plates 3 extends within the edge 12 of the remaining heat transfer plates 4, it becomes simple to insert a welding set in the flow passage in a correct position, regarding both axially and radially positions, to be able to weld the modules 2 to each other.

According to the present invention at least one of the fluids is arranged to flow through the plate heat exchanger 1 in several passes, and at least one disc of a pass 13 is introduced in at least one flow passage. The disc of the pass 13 is arranged towards two outer heat transfer plates 3 joined with each other to essentially seal said opening 10.

Figure 3:
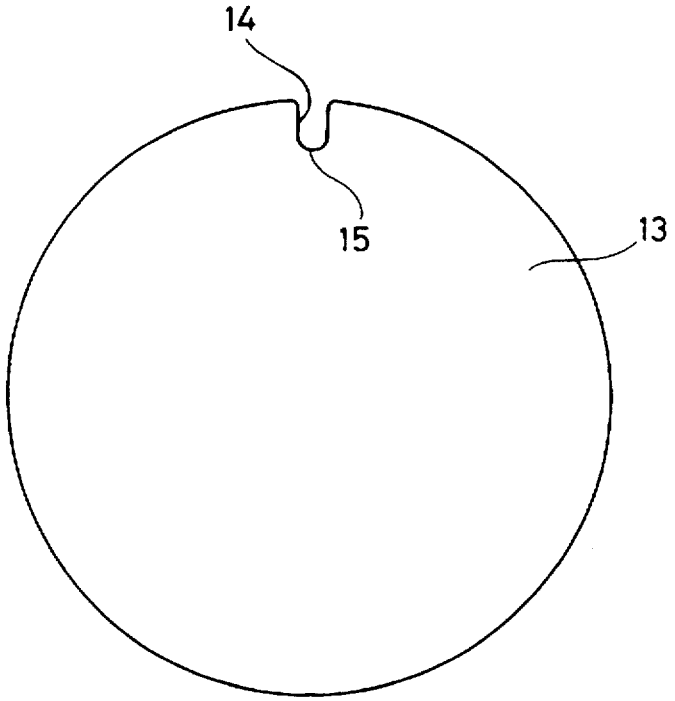
FIG. 3 shows a front-view of a disc of a pass, as included in the plate heat exchanger according to FIG. 1.
Figure 4:
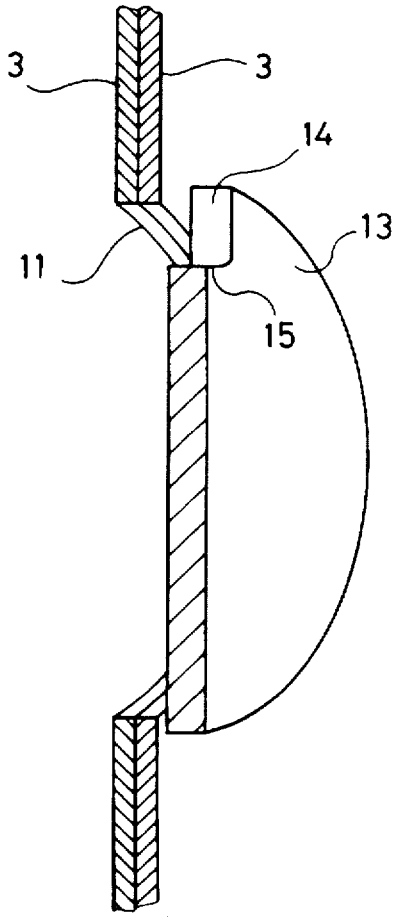
FIG. 4 shows a schematic cross-section in perspective of said disc of a pass abutting towards the outer heat transfer plates of two joined modules.

FIGS. 3 and 4 show a round disc of a pass 13 provided with a recess 14, having a rounded bottom 15.

Figure 5:
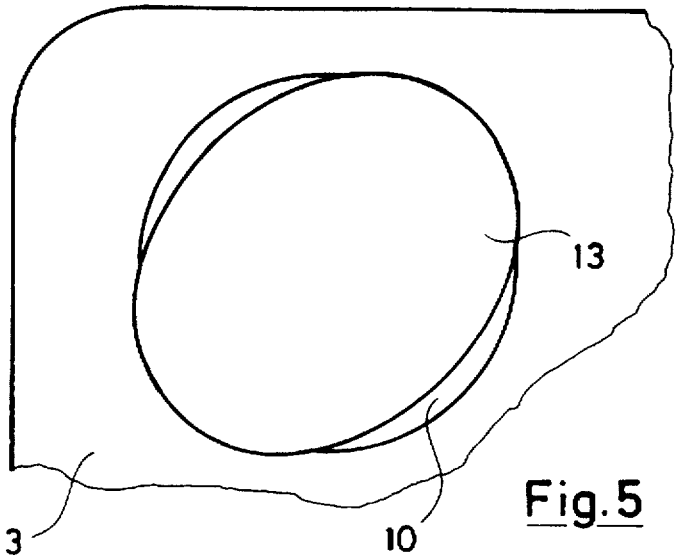
FIG. 5 shows an oval disc over an opening in an outer heat transfer plate.
Figure 6:
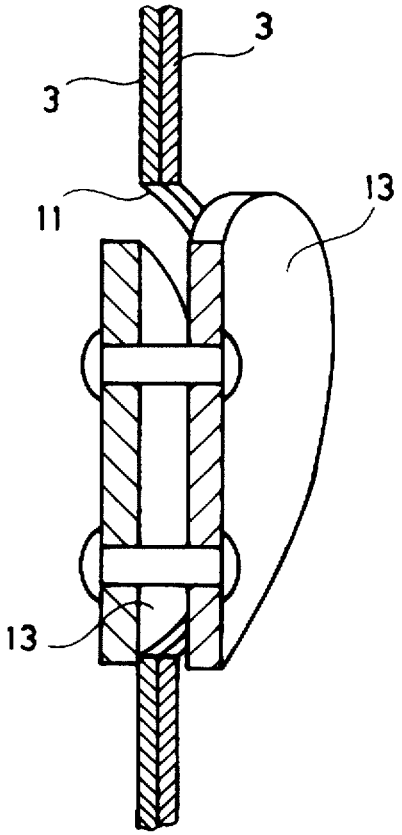
FIG. 6 shows two discs arranged towards each other.

FIG. 5 shows and oval disc 13, an outer heat transfer plate 3 and an opening 10 in the outer heat transfer plate 3. The shorter diameter of the disc 13 is smaller than the diameter of the opening 10. FIG. 6 shows two discs 13 arranged towards each other, turned relative to each other and joined by rivets. The discs 13 are oriented in such a way that an upper slot for ventilation of the flow passage is formed.

The disc of the pass 13 must be larger than the edge 11 of the opening to essentially seal said opening 10. This causes problem at the assembly of the disc of the pass 13, since the modules 2 must be joined firstly to each other. Subsequently the disc of the pass 13 should be inserted through an opening 10 in the outer heat transfer plate 3 and through the module 2 to the other outer heat transfer plate 3. This can be effected if an imaginary straight line from the periphery of the disc of the pass through its centre, in at least one direction, has a length that is shorter than the diameter of the openings 10 in the outer heat transfer plates 3. Through these arrangements the disc of the pass 13 may be coaxed past the first outer heat transfer plate 3, naturally with the assumption that the disc of the pass 13 is smaller than the opening of the inner heat transfer plates, and that the size of the module 2 is such that the disc of the pass 13 is given sufficient space in the flow passage to be inclined to a certain amount.

By forming the disc of the pass 13 essentially circular, having a diameter that exceeds the diameter of the openings 10 in the outer heat transfer plates 3, and by forming a recess 14, in which the edge 11 of an outer heat transfer plate 3 partly can be inserted, the disc of the pass 13 may, if the distance from the bottom of the recess 14 to the periphery of the disc of the pass in all directions is shorter than the diameter of the openings 10 in the outer heat transfer plates 3, be brought past the edge 11 in the outer heat transfer plate 3. The size of the recess 14 is selected such that the disc of the pass 13 can be brought perpendicular towards the module 2, whereby the edge 11 of the outer heat transfer plate 3 may be inserted in the recess 14. The disc of the pass 13 is turned subsequently in the flow passage and past the opposite edge 11 of the outer heat transfer plate 3. Thus, the width of the recess 14 will admit such turning and preferably the bottom 15 is rounded.

When the disc of the pass 13 is located in an upper flow passage it is suitably orientated in such way that the recess 14 is turned upwards, forming an upper slot for ventilation of the flow passage. By that air existing in the flow passage is prevented to accumulate close to the disc of the pass 13. In the same manner the disc of the pass 13 in a lower flow passage is orientated in such way that the recess 14 is turned downwards, forming a lower slot for drainage of the flow passage.

Alternatively, the disc of the pass 13 can be essentially oval, with its shorter diameter being shorter than the diameter of the openings 10 in the outer heat transfer plates 3. To essentially seal said opening 10 several discs of the pass 13 can be arranged towards each other and turned relative to each other. Thus, possible slots on each side of an oval disc of a pass 13 can be covered by the next disc of a pass 13, which is suitably formed, for instance by pressing, to closely seal towards the outer heat transfer plate 3. The disc of the pass 13 in an upper flow passage is suitably orientated in such way that an upper slot for ventilation of the flow passage is formed and correspondingly the discs of the pass 13 in a lower flow passage are orientated in such way that a lower slot for drainage of the flow passage is formed.

The above described discs of the pass 13 are joined with at least one of the two outer heat transfer plates 3 joined with each other or with each other by means of welding, soldering, gluing, riveting or similar known methods.

Naturally the discs of the pass could also be provided with a separate hole for ventilation or drainage. The discs of the pass 13 can be formed of a thicker plate than the heat transfer plates 3 and also be provided with a reinforcement in shape of pressed corrugations or similar. The discs of the pass 13 could also be formed in two or several parts, which after the introduction in the flow passage are welded together.

What is claimed is:

1. A plate heat exchanger (1) for heat transfer between two fluids, comprising at least two modules (2), each comprising two outer heat transfer plates (3) and between them several inner heat transfer plates (4), said inner and outer heat transfer plates being principally rectangular, permanently joined with each other and provided with openings (10) for the respective fluids in their corner portions to form flow passages through the plate heat exchanger (1), said outer heat transfer plates (3) having smaller openings than said inner heat transfer plates (4) for at least one of the fluids and said at least two modules (2) being permanently joined to each other around said smaller openings in their respective two outer heat transfer plates (3) facing each other, wherein at least one disc (13) is transfer plates (3) joined with each other to essentially close arranged in one of said at least two modules (2) and abuts against the outer heat transfer plate (3) thereof, which forms one of said two outer heat transfer plates facing each other, such that it essentially closes the relevant flow passage where the at least two modules (2) are joined to each other.

2. The plate heat exchanger (1) according to claim 1, wherein an imaginary straight line drawn from the periphery of the at least one disc (13) through its center in at least one direction has a length that is shorter than the diameter of said smaller openings in the outer heat transfer plates (3).

3. The plate heat exchanger (1) according to claim 2, wherein the at least one disc (13) is essentially circular with a diameter exceeding the diameter of said smaller openings in the outer heat transfer plates (3) and the at least one disc (13) is provided with a recess (14), in which an outer heat transfer plate (3) partly can be inserted, and the distance from the bottom (15) of the recess (14) to the periphery of the at least one disc (13) in all directions is shorter than the diameter of said smaller openings in the outer heat transfer plates (3).

4. The plate heat exchanger (1) according to claim 3, wherein said at least one disc (13) is in an upper flow passage and is orientated in such way that the recess (14) is turned upwards, forming an upper slot for ventilation of the flow passage.

5. The plate heat exchanger (1) according to claim 3, wherein said at least one disc (13) is in a lower flow passage and is orientated in such way that the recess (14) is turned downwards, forming a lower slot for drainage of the flow passage.

6. The plate heat exchanger (1) according to claim 2, wherein the at least one disc (13) is essentially oval and has a longer and a shorter diameter, with its shorter diameter being shorter than the diameter of said smaller openings in the outer heat transfer plates (3).

7. The plate heat exchanger (1) according to claim 6, wherein several discs (13) are arranged towards each other and are tuned relative to each other.

8. The plate heat exchanger (1) according to claim 7, wherein the discs (13) in an upper flow passage are orientated in such way that an upper slot for ventilation of the flow passage is formed.

9. The plate heat exchanger (1) according to claim 7, wherein the discs (13) in a lower flow passage are orientated in such way that a lower slot for drainage of the flow passage is formed.

10. The plate heat exchanger (1) according to claim 1, wherein said at least one disc (13) is joined with at least one of two outer heat transfer plates (3) joined with each other by means of welding or soldering or gluing or riveting or combinations thereof.

* * * * *

UNITED STATES PATENT AND TRADEMARK OFFICE

CERTIFICATE OF CORRECTION

PATENT NO. : 5,778,975

DATED : July 14, 1998

INVENTOR(S) : Mats Nilsson

It is certified that error appears in the above-identified patent and that said Letters Patent is hereby corrected as shown below:

Claim 1, Col. 4, lines 61-62, delete "transfer plates (3) joined with each other to essentially close".

Signed and Sealed this

Fifth Day of January, 1999

*Attest:*

*Attesting Officer*

*Acting Commissioner of Patents and Trademarks*